US012589847B2

(12) United States Patent
Chen et al.

(10) Patent No.: US 12,589,847 B2
(45) Date of Patent: Mar. 31, 2026

(54) BIOMIMETIC AQUATIC DEVICE

(71) Applicant: Pioneer Material Precision Tech Co., Ltd., New Taipei City (TW)

(72) Inventors: Chih-Sheng Chen, New Taipei City (TW); Ching-Hung Liu, New Taipei City (TW)

(73) Assignee: PIONEER MATERIAL PRECISION TECH CO., LTD., New Taipei City (TW)

( * ) Notice: Subject to any disclaimer, the term of this patent is extended or adjusted under 35 U.S.C. 154(b) by 458 days.

(21) Appl. No.: 18/469,425

(22) Filed: Sep. 18, 2023

(65) Prior Publication Data

US 2025/0002129 A1 Jan. 2, 2025

(30) Foreign Application Priority Data

Jun. 27, 2023 (TW) ..... 112123792

(51) Int. Cl.

| | |
|---|---|
| ***B63B 43/08*** | (2006.01) |
| ***B63G 8/00*** | (2006.01) |
| ***B63G 8/14*** | (2006.01) |
| ***B63G 8/26*** | (2006.01) |

(52) U.S. Cl.

CPC ..... *B63G 8/14* (2013.01); *B63G 8/001* (2013.01); *B63B 43/08* (2013.01); *B63G 2008/002* (2013.01); *B63G 8/26* (2013.01)

(58) Field of Classification Search

CPC ..... B63B 43/08; B63B 22/20; B63G 8/14; B63G 8/001; B63G 2008/002

See application file for complete search history.

(56) References Cited

U.S. PATENT DOCUMENTS

| | | | | |
|---|---|---|---|---|
| 11,427,287 | B1 * | 8/2022 | Dollar | B63B 43/08 |
| 2014/0202367 | A1 * | 7/2014 | Dollar | B63B 43/08 114/124 |
| 2023/0013643 | A1 * | 1/2023 | Wan | B63G 8/22 |

FOREIGN PATENT DOCUMENTS

| | | | | |
|---|---|---|---|---|
| CN | 113581427 | A * | 11/2021 | B63G 8/14 |
| CN | 114604395 | A * | 6/2022 | G05D 1/0011 |
| CN | 115071933 | A | 9/2022 | |

* cited by examiner

*Primary Examiner* — Andrew Polay

(74) *Attorney, Agent, or Firm* — HSML P.C.

(57) ABSTRACT

A biomimetic aquatic device includes a housing, a driving module, a cam, and a weight unit. The driving module is disposed in a receiving space of the housing, and includes a driving shaft rotatable about its own axis. The cam is mounted co-rotatably to the driving shaft, and has a cam groove formed in an outer surface of the cam and having at least a portion that extends spirally about the axis. The weight unit is mounted to the driving module, is movable along the axis relative to the driving module, and includes an engaging member engaging and movable along the cam groove. When the driving shaft and the cam are rotated, the weight unit moves relative to the driving module along the axis via engagement between the engaging member and the cam groove, thereby changing a center of gravity of the biomimetic aquatic device.

8 Claims, 11 Drawing Sheets

BIOMIMETIC AQUATIC DEVICE

CROSS-REFERENCE TO RELATED APPLICATION

This application claims priority to Taiwanese Invention Patent Application No. 112123792, filed on Jun. 27, 2023.

FIELD

The disclosure relates to a biomimetic device, and more particularly to a biomimetic aquatic device.

BACKGROUND

A conventional biomimetic aquatic device, e.g., a biomimetic fish, is able to ascend or descend in the water and to emulate swimming motion of aquatic creatures. Generally, the conventional biomimetic aquatic device includes a buoyant regulation mechanism that supplies and drains water in an inner space of the conventional biomimetic aquatic device, so a total weight of the conventional biomimetic aquatic device may be adjusted as desired to enable ascending or descending movement of the conventional biomimetic aquatic device. However, an inner space that is large enough is needed to accommodate sufficient water for the ascending and descending movement of the conventional biomimetic aquatic device. Thus, an overall volume of the conventional biomimetic aquatic device is relatively large and so the biomimetic aquatic device is not capable to emulate smaller aquatic creatures. In addition, a waterproof function and water leakage prevention are also needed for the buoyant regulation mechanism and the inner space of the conventional biomimetic aquatic device, so manufacturing cost of such conventional biomimetic aquatic device is relative high.

On the other hand, the buoyant regulation mechanism may employ a motor that drives a screw rod to rotate so a weight device that threadedly engages the screw rod moves along the screw rod to adjust a center of gravity of the conventional biomimetic aquatic device and thus enabling the ascending or descending movement of the conventional biomimetic aquatic device in the water. However, the screw rod may be worn out by the weight device after a period time of use, which may result in a high failure rate of the conventional biomimetic aquatic device.

SUMMARY

Therefore, an object of the disclosure is to provide a biomimetic aquatic device that can alleviate at least one of the drawbacks of the prior art.

According to the disclosure, a biomimetic aquatic device includes a housing, a driving module, a cam, and a weight unit. The housing has a receiving space therein. The driving module is disposed in the receiving space, and includes a driving shaft rotatable about its own axis that extends in a front-rear direction. The cam is mounted co-rotatably to the driving shaft, and has a cam groove formed in an outer surface of the cam and having at least a portion that extends spirally about the axis of the driving shaft. The weight unit is mounted to the driving module, is movable along the axis of the driving shaft relative to the driving module, and includes an engaging member engaging and movable along the cam groove. When the driving shaft and the cam are rotated, the weight unit moves relative to the driving module along the axis of the driving shaft via engagement between the engaging member and the cam groove, thereby changing a center of gravity of the biomimetic aquatic device.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
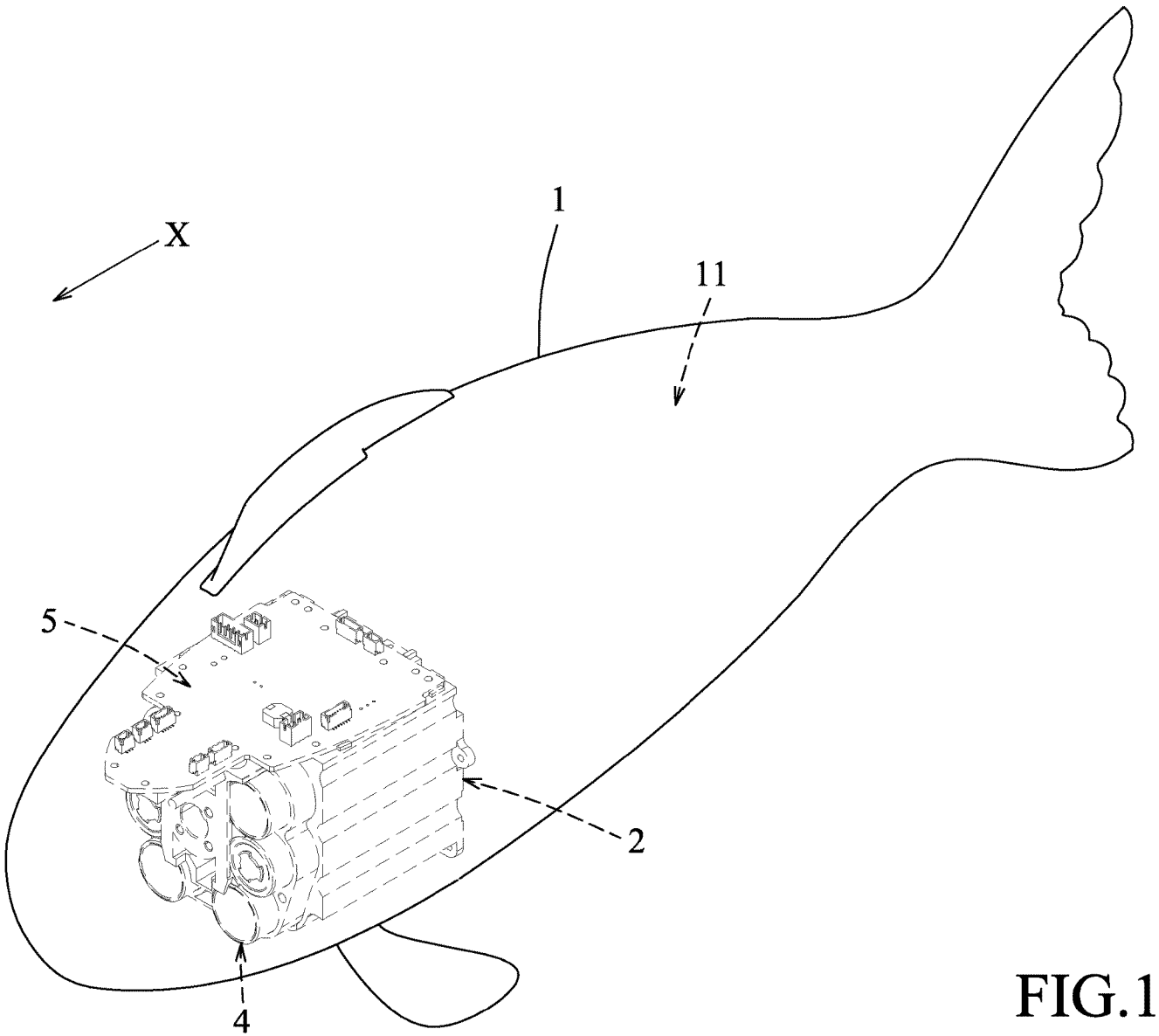
FIG. 1 is a schematic perspective view illustrating a biomimetic aquatic device of an embodiment of according to the present disclosure.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
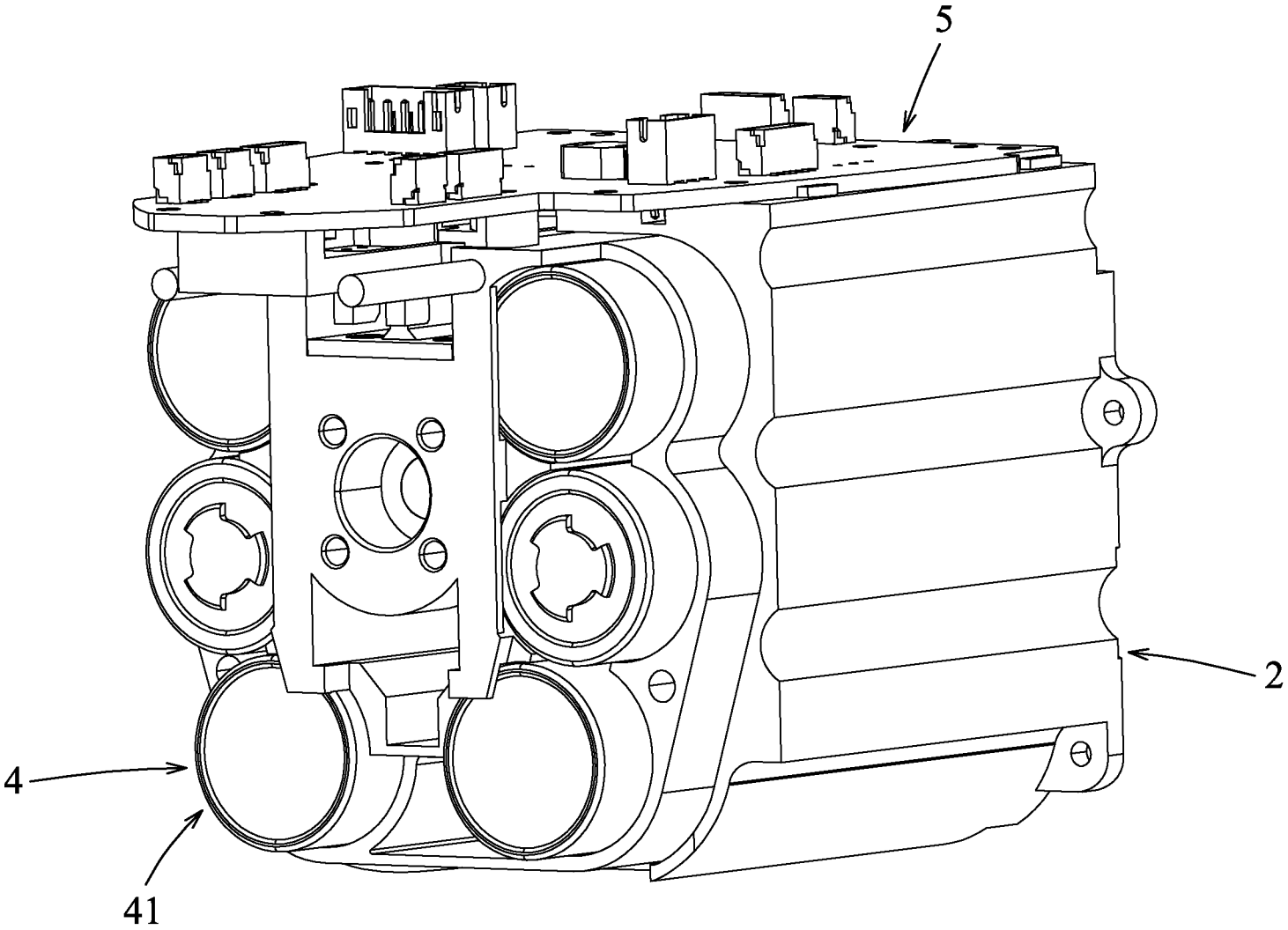
FIG. 2 is a fragmentary perspective view illustrating structure of a driving module, a weight unit, and a control module of the embodiment.
Figure 3:
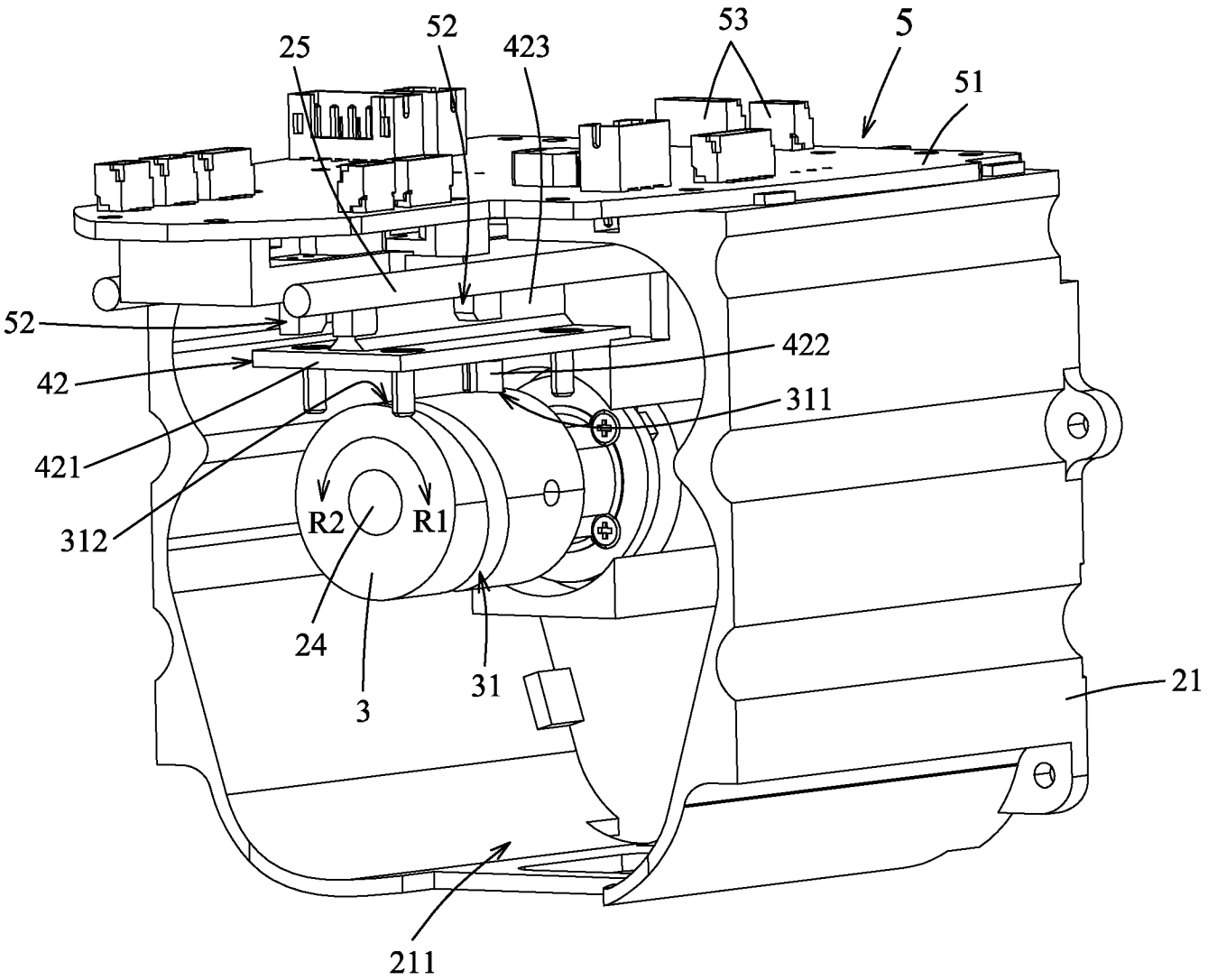
FIG. 3 is a fragmentary perspective view illustrating structure of the driving module, the control module, and a cam of the embodiment with a portion of the weight unit being removed.

Referring to FIGS. 1 to 3, a biomimetic aquatic device of an embodiment according to the present disclosure is shown. The biomimetic aquatic device is capable of ascending or descending in the water by changing a center of gravity of the biomimetic aquatic device. The biomimetic aquatic device includes a housing 1, a driving module 2, a cam 3 (see FIG. 3), a weight unit 4, and a control module 5. The housing has a receiving space 11 therein. The shape of the housing 1 may be designed as a fish or other aquatic creatures, and the present disclosure is not limited thereto.

Figure 4:
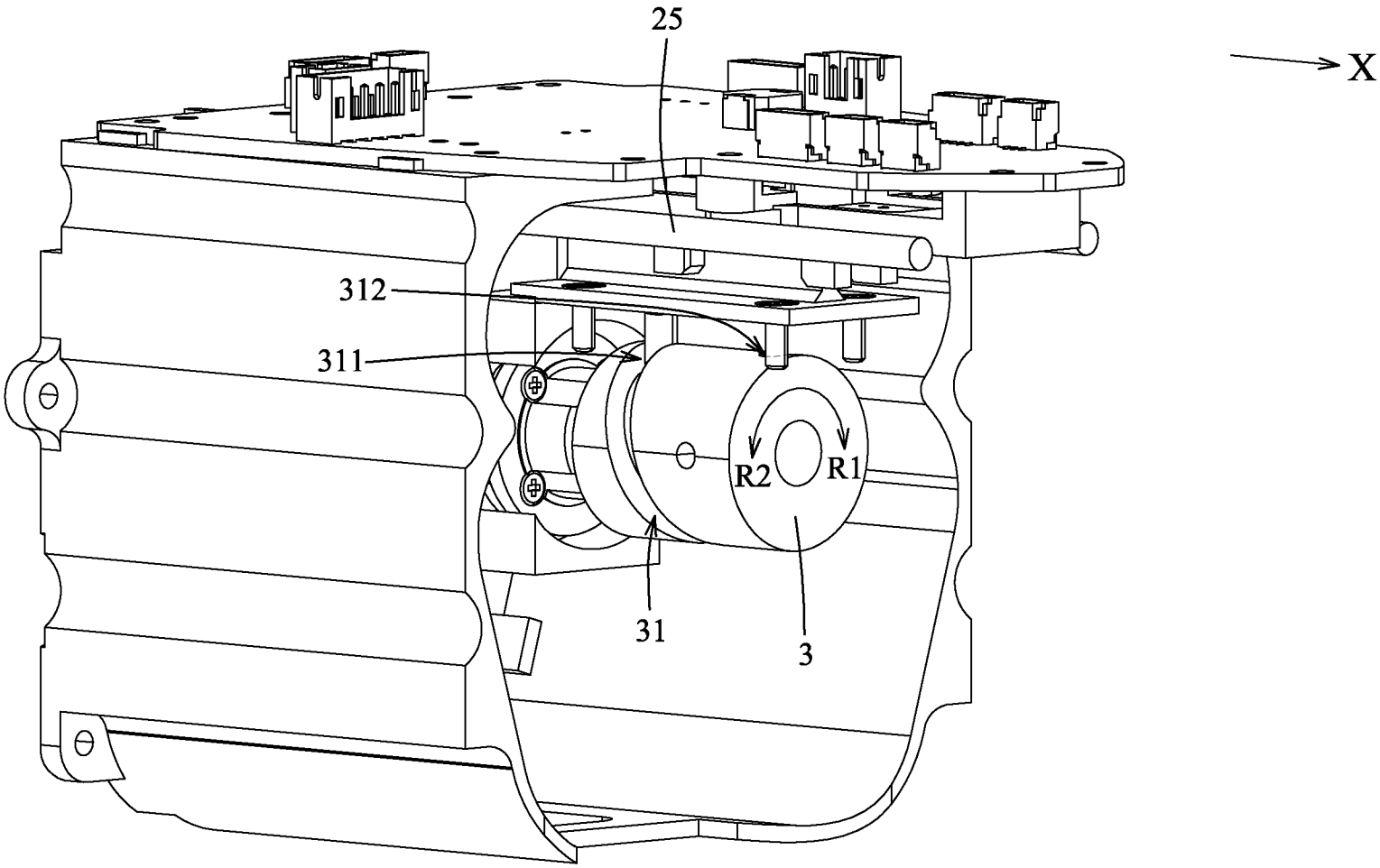
FIG. 4 is a perspective view of FIG. 3 from another view of angle different from FIG. 3.
Figure 5:
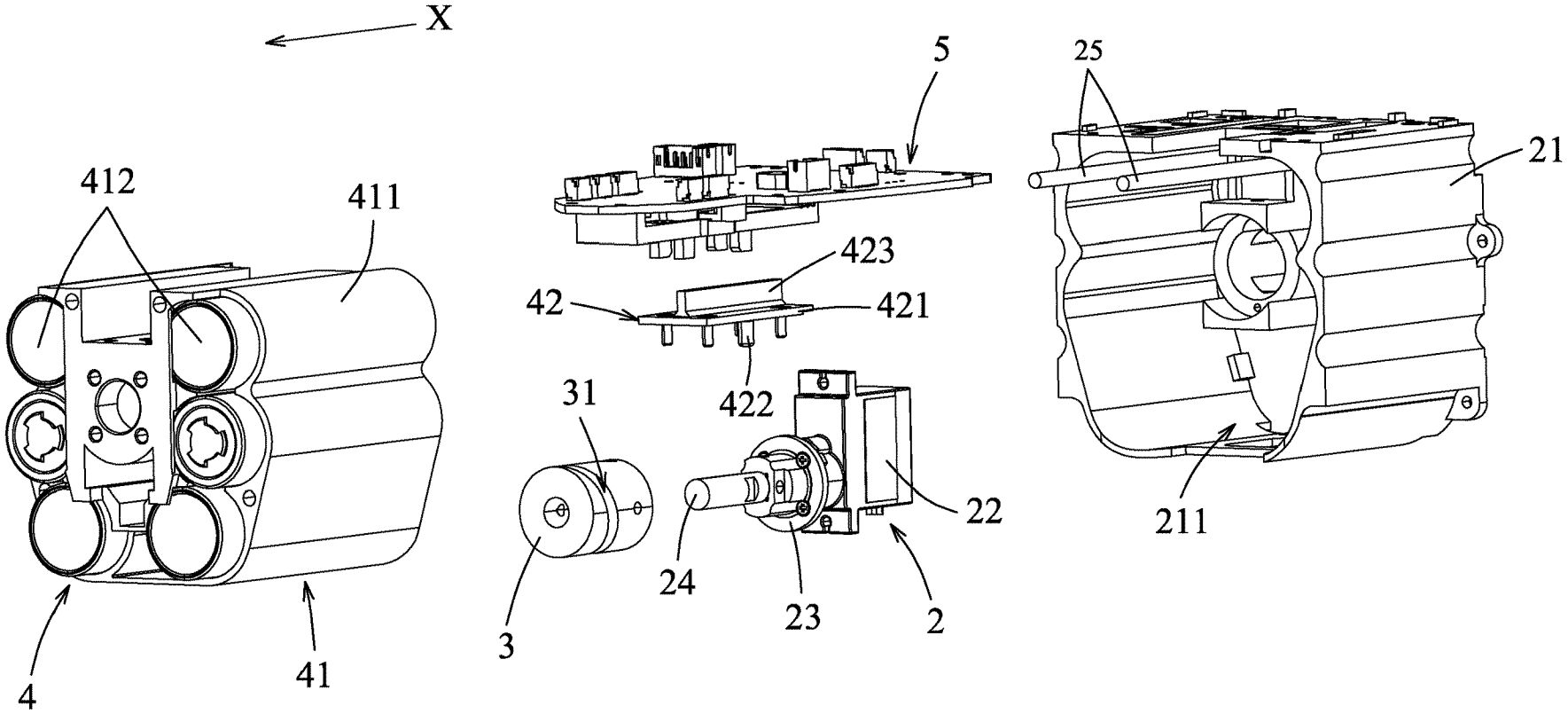
FIG. 5 is a partly exploded perspective view of FIG. 2.

Further referring to FIGS. 4 and 5, the driving module 2 is disposed in the receiving space 11, and includes a base seat 21, a motor 22, a shaft connector 23, a driving shaft 24, and two guiding rods 25. The base seat 21 has an accommodating space 211 having an opening open forwardly in a front-rear direction (X), but is not limited thereto. For example, the opening of the accommodating space 211 may open rearwardly, or the accommodating space 211 may have two openings open respectively forwardly and rearwardly.

In this embodiment, the motor 22 is mounted to the base seat 21 and is disposed in the accommodating space 211, but is not limited to this aspect. In other embodiments, the motor 22 may be disposed outside the accommodating space 211 and mounted on components disposed on the housing 1 or directly on the housing 1. The shaft connector 23 is disposed in the accommodating space 211, and includes front and rear end portions connected respectively to the driving shaft 24 and the motor 22. The driving shaft 24 is disposed in the accommodating space 211, is rotatable about its own axis that extends in the front-rear direction (X). Specifically, when the motor 22 starts to rotate, the shaft connector 23 is driven thereby to rotate in a clockwise direction (R1) or a counterclockwise direction (R2) opposite to the clockwise direction (R1) so the driving shaft 24 rotates in a direction the same as the shaft connector 23. The guiding rods 25 are spaced apart from each other in a left-right direction perpendicular to the front-rear direction (X) and each of the guiding rods 25 extends forwardly from the base seat 21.

As shown in FIGS. 3 to 5, the cam 3 is cylindrical, is sleeved on and mounted co-rotatably to the driving shaft 24, and has a cam groove 31 formed in an outer surface of the cam 3 and having at least a portion that extends spirally about the axis of the driving shaft 24. Specifically, the cam groove 31 has a first positioning portion 311 disposed at a rear portion of the cam 3 and proximate to the motor 22, and a second positioning portion 312 disposed at a front portion of the cam 3 and distal from the motor 22.

Referring to FIGS. 2 to 5, the weight unit 4 is mounted to the base seat 21 of the driving module 2, and is movable along the axis of the driving shaft 24 relative to the driving module 2, thereby changing the center of gravity of the biomimetic aquatic device. Specifically, the guiding rods 25 extend through the weight unit 4 so the weight unit 4 is movable along the guiding rods 25, and is not movable in the left-right direction. In this embodiment, a rear portion of the weight unit 4 is retained in the accommodating space 211 and movable relative to the accommodating space 211 along the axis of the driving shaft 24 so an overall dimension occupied by the weight unit 4 and the driving module 2 is relatively small. In some embodiments, the weight unit 4 includes a power source assembly 41 electrically connected to the motor 22 of the driving module 2 for supplying electric power to the driving shaft 24, and a driven element 42 mounted fixedly to the power source assembly 41. In this embodiment, the power source assembly 41 serves as a weight for changing the center of gravity of the biomimetic aquatic device, and thus no additional weight is required to be disposed in the biomimetic aquatic device. Furthermore, the power source assembly 41 extends into the accommodating space 211, is movable along the axis of the driving shaft 24, and surrounds the cam 3. In this embodiment, the power source assembly 41 includes a battery case 411 and a plurality of batteries 412 removably disposed in the battery case 411. The battery 411 is formed with a receiving groove 413 (see FIG. 6) open rearwardly. The guiding rods 25 extend through the battery case 411 so the battery case 411 is movable along the guiding rods 25, and the receiving groove 413 receives the cam 3 and the driving shaft 24 therein to prevent the battery case 411 from interfering with receiving the cam 3 and the driving shaft 24 during movement of the weight unit 4 along the guiding rods 25. In this way, the cam 3, the weight unit 4, and the driving module 2 occupy a relatively small space in receiving space 11 (see FIG. 1), thus the biomimetic aquatic device may emulate aquatic creatures that are relatively small. It should be noted that, under the premise of the abovementioned structure, the base seat 21 may be modified to be complementary in shape with the battery case 411 thus supporting the battery case 411 to be stably movable therein along the axis of the driving shaft 24.

Referring to FIGS. 3 to 6, the driven element 42 includes a plate body 421, an engaging member 422, and a sliding block 423 connected to the plate body 421. The plate body 421 extends along the axis of the driving shaft 24. The sliding block 423 and the engaging member 422 extend away from each other respectively from two sides of the plate body 421 that are opposite in a direction transverse to the front-rear direction (X) and the left-right direction. The engaging member 422 engages and is movable along the cam groove 31. In this embodiment, the plate body 421 is mounted on top of the battery case 411, the sliding block 423 extends upwardly from a top side of the plate body 421 and extends along the axis of the driving shaft 24, and the engaging member 422 protrudes downwardly from a bottom side of the plate body 421 and extends through the receiving groove 413 into the cam groove 31.

Figure 6:
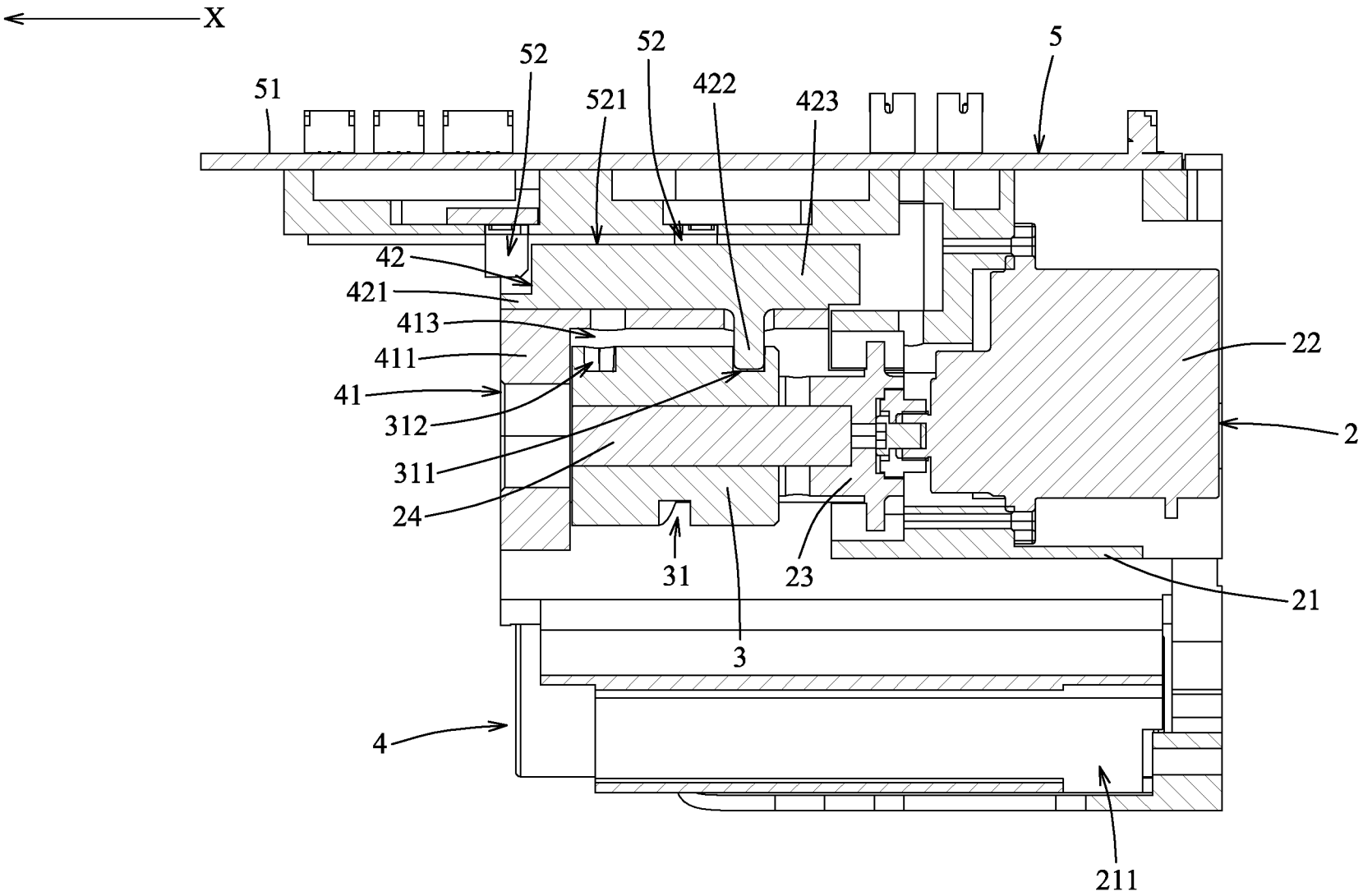
FIG. 6 is a sectional view of FIG. 2, illustrating the driving module, the cam, and the weight unit when the embodiment is in a horizontal posture.

Referring to FIGS. 3, 5, and 6, the control module 5 is electrically connected to the motor 22, and includes a circuit board 51 mounted outwardly of the base seat 21 and configured to control rotation of the driving shaft 24, two sensors 52 electrically connected to the circuit board 51 and spaced apart from each other in the front-rear direction (X), and a plurality of electronic components 53 mounted on a side surface of the circuit board 51 opposite to the sensors 52 and electrically connected to the circuit board 51. The sensors 52 detect a position of the sliding block 423 of the driven element 42. The circuit board 51 controls rotation of the driving shaft 24 after receiving signals generated by the sensors 52. Specifically, when both of the sensors 52 detect that the sliding block 423 of the driven element 42 is contact therewith while the driven element 42 is moving along the cam groove 31, the circuit board 51 controls the motor 22 of the driving module 2 to continuously rotate, and thus the driven element 42 may continuously move along the cam groove 31. On the other hand, when only one of the sensors 52 detects that the sliding block 423 is contact therewith while the driven element 42 is moving along the cam groove 31, the circuit board 51 controls the driving module 2 to rotate in a direction opposite to its original rotational direction so the driven element 42 moves toward the other one of the sensors 52. In this way, a range of movement of the driven element 42 may be limited by the sensors 52. In this embodiment, the control module 5 is mounted on top of the base seat 21, and the weight unit 4 to reduce its occupation space in the front-rear direction (X). In this embodiment, the sensors 52 are photoelectric limit switches, and the present disclosure is not limited thereto.

Referring to FIGS. 6 to 9, an operation of the embodiment of the biomimetic aquatic device will described in the following. First, when the biomimetic aquatic device is to be moved to a descending posture (see FIG. 9) from an ascending posture or a horizontal posture (see FIG. 7), the control module 5 is operated to actuate operation of the motor 22. When the motor 22 is controlled by the control module 5 to drive rotation of the driving shaft 24 in the clockwise direction (R1), the cam 3 co-rotates with the driving shaft 24 in the clockwise direction (R1). When the driving shaft 24 and the cam 3 are rotated, the weight unit 4 moves forwardly relative to the driving module 2 along the axis of the driving shaft 24 via engagement between the engaging member 422 and the cam groove 31, thereby changing the center of gravity of the aquatic biomimetic device. During this process, the engaging member 422 moves along the cam groove 31 from the first positioning portion 311 (see FIG. 6) to the second positioning portion 312 (see FIG. 8), so the power source assembly 41 moves with the engaging member 422 away from the driving module 2 to thereby changing the center of gravity of the biomimetic aquatic device to be at the front. In this way, the biomimetic aquatic device tilts downwardly when swimming in the water, so a front section of the biomimetic aquatic device descends gradually relative to a rear section of the biomimetic biological device to move the biomimetic aquatic device to the descending posture.

On the contrary, when the biomimetic aquatic device is to be moved from the descending posture to the horizontal posture or the ascending posture, the motor 22 is also controlled by the control module 5 to drive rotation of the driving shaft 24 and the cam 3 in the counterclockwise direction (R2). At this time, the engaging member 422 moves rearwardly from the second positioning portion 312 to the first positioning portion 311 along the cam groove 31 so the power source assembly 41 moves rearwardly toward the driving module 2, thereby changing the center of gravity of the biomimetic aquatic device to be at the rear. Thus, the biomimetic aquatic device tilts upwardly when swimming in the water, and the front section thereof ascends gradually relative to the rear section thereof to move the biomimetic aquatic device to the horizontal posture or the ascending posture.

Figure 7:
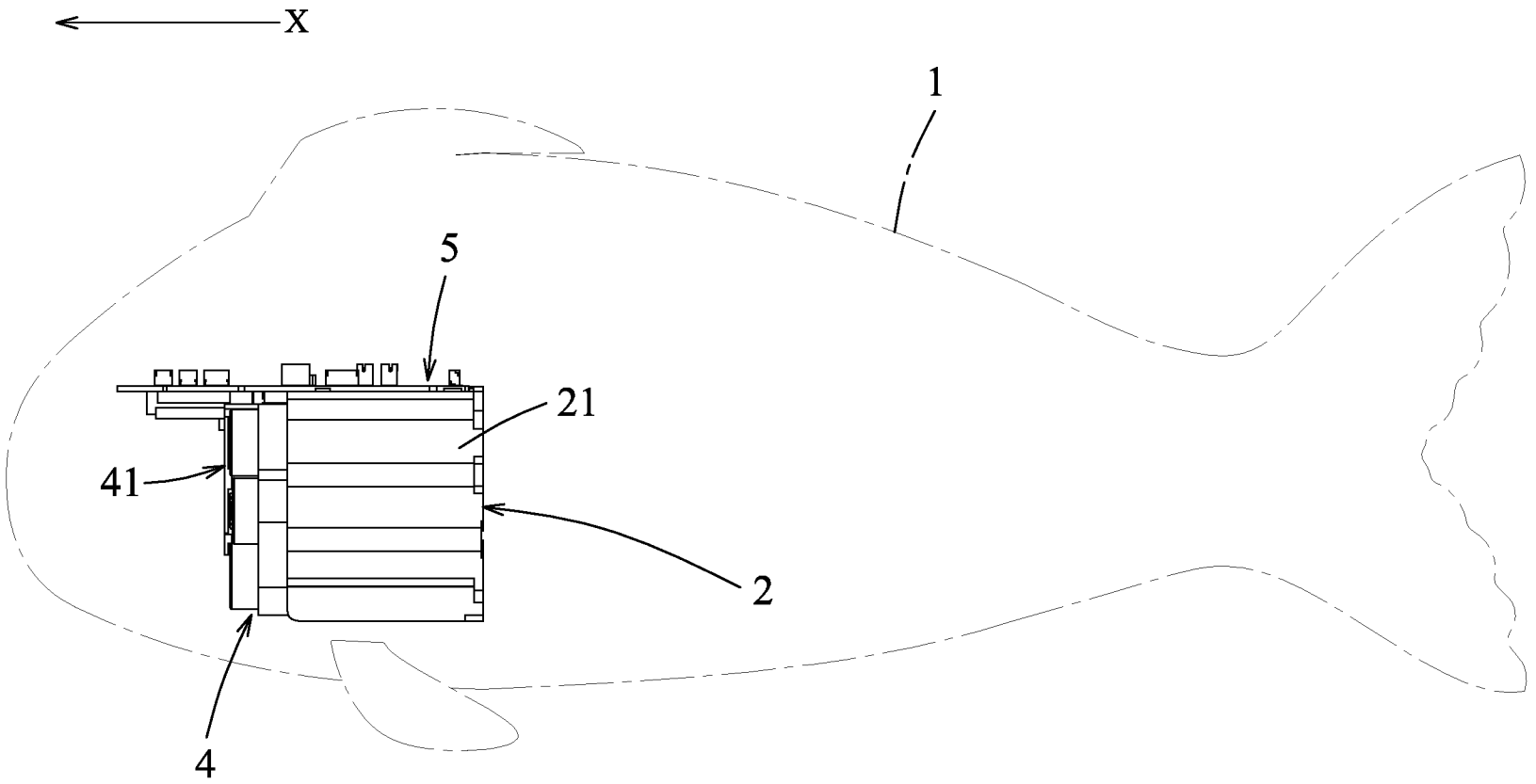
FIG. 7 is a schematic view of the embodiment being in the horizontal posture.
Figure 8:
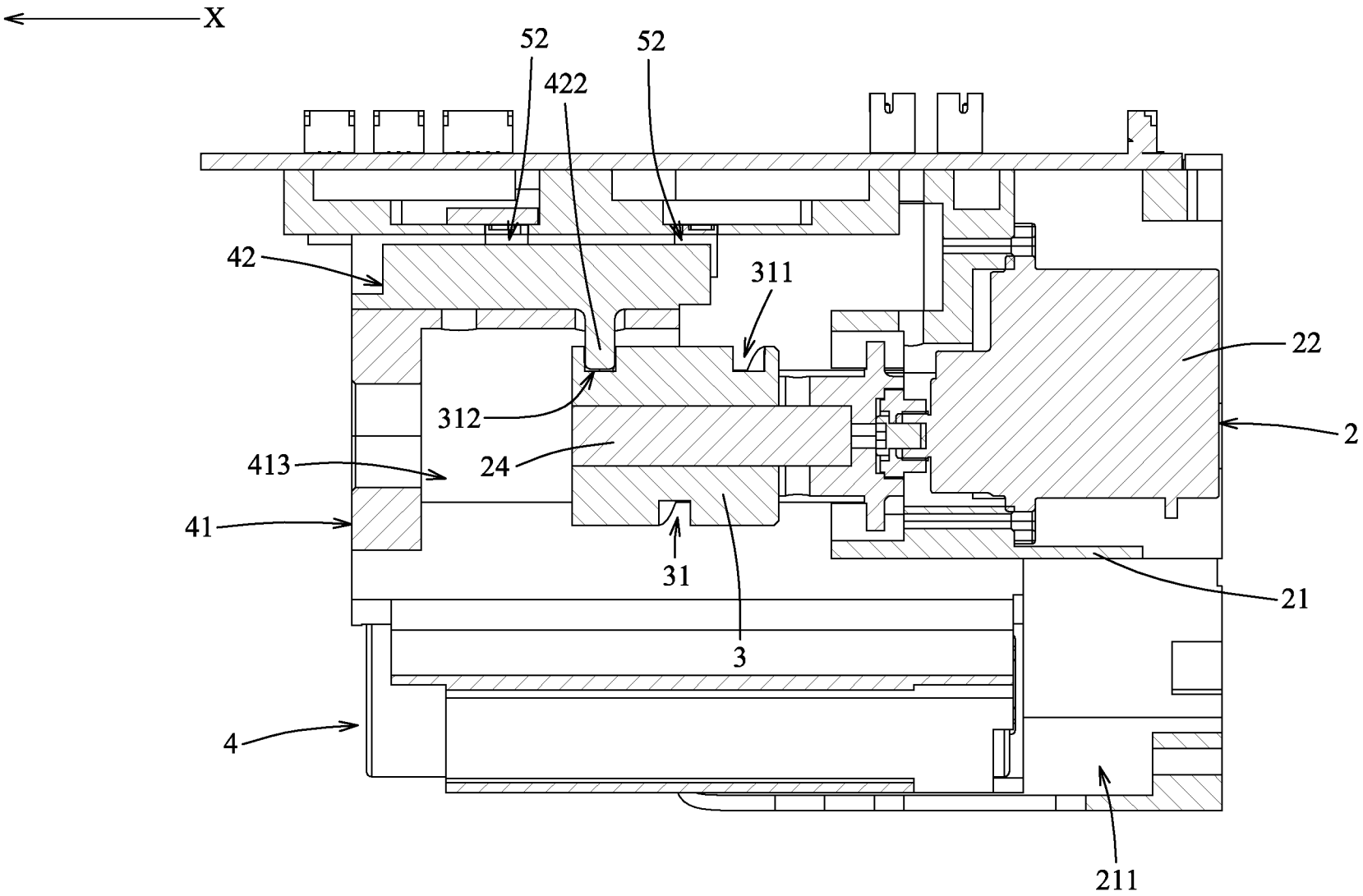
FIG. 8 is a sectional view similar to FIG. 6, but illustrating the driving module, the cam, and the weight unit when the embodiment is in a descending posture.
Figure 9:
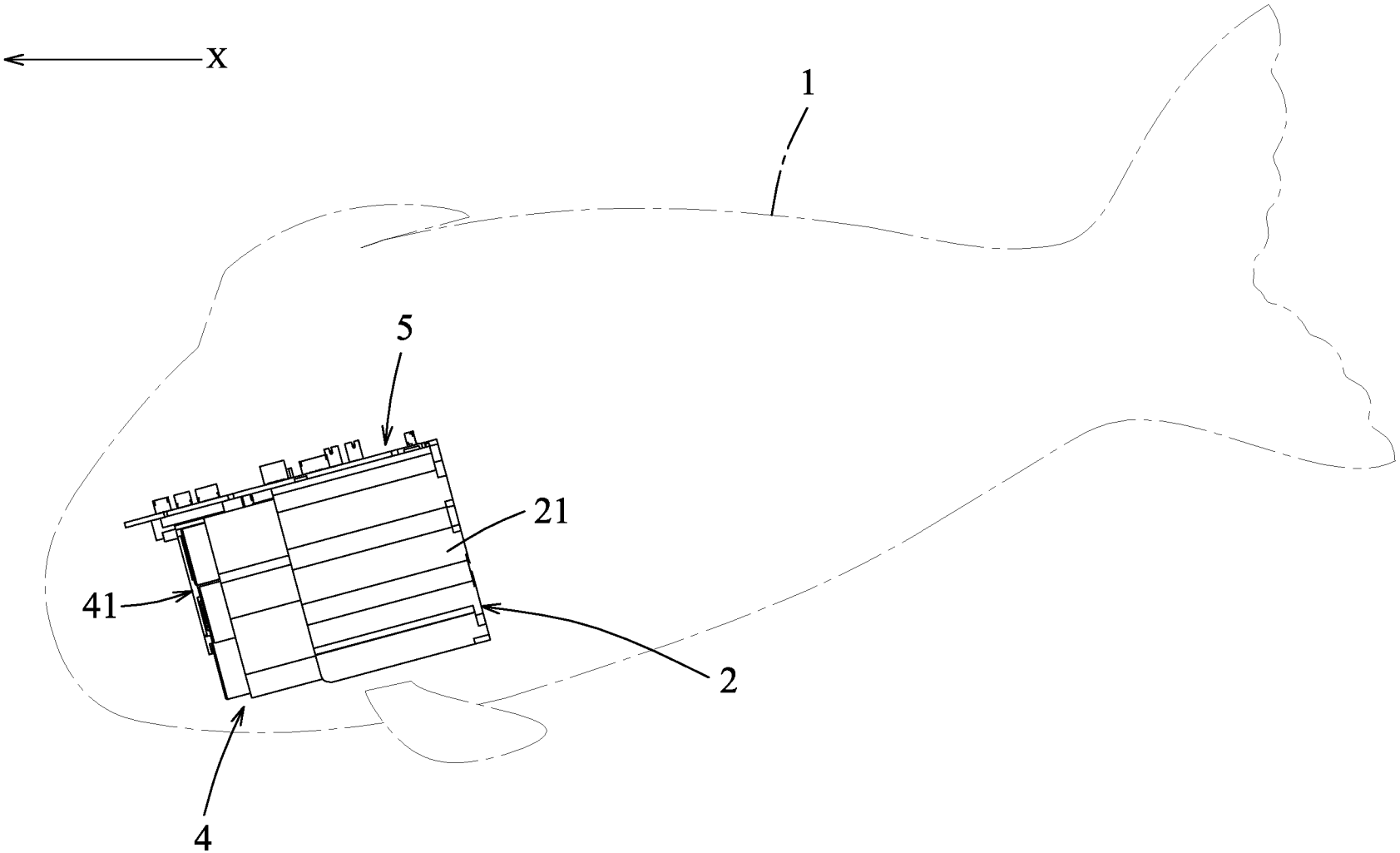
FIG. 9 is a schematic view illustrating the embodiment being in the descending posture.

Referring to FIGS. 3, 6 and 7, since the control module 5 is able to control a rotational speed of the motor 22 and thus the driving shaft 24 and the cam 3, a moving speed of the weight unit 4 may also be controlled. Additionally, the number of turns that the driving shaft 24 and cams 3 rotate may also be controlled by the control module 5 such that the engaging member 422 may be moved to a desired position between the first positioning portion 311 and the second positioning portions 312 of the cam groove 31, thereby realizing a precise adjustment of the center of gravity along the axis of the driving shaft 24.

In this embodiment, the cam groove 31 extends spirally about the axis of the driving shaft 24. The first positioning portion 311 and the second positioning portion 312 are disposed on the same side of the axis of the driving shaft 24. As such, a maximum distance between the first positioning portion 311 and the second positioning portion 312 along the axis of the driving shaft 24 is a maximum range of movement, i.e., a stroke, of the driven element 42. When the cam 3 rotates for one turn in the clockwise direction (R1), the engaging member 422 moves from the first positioning portion 311 to the second positioning portion 312. Similarly, when the cam 3 rotates for one turn in the counterclockwise direction (R2), the engaging member 422 moves from the second positioning portion 312 to the first positioning portion 311. By virtue of the spiral design of the cam groove 31, the number of turns that the motor 22 drives rotation of the driving shaft 24 and the cam 3 may be reduced such that efficiency and durability of the motor 22 may be improved.

Figure 10:
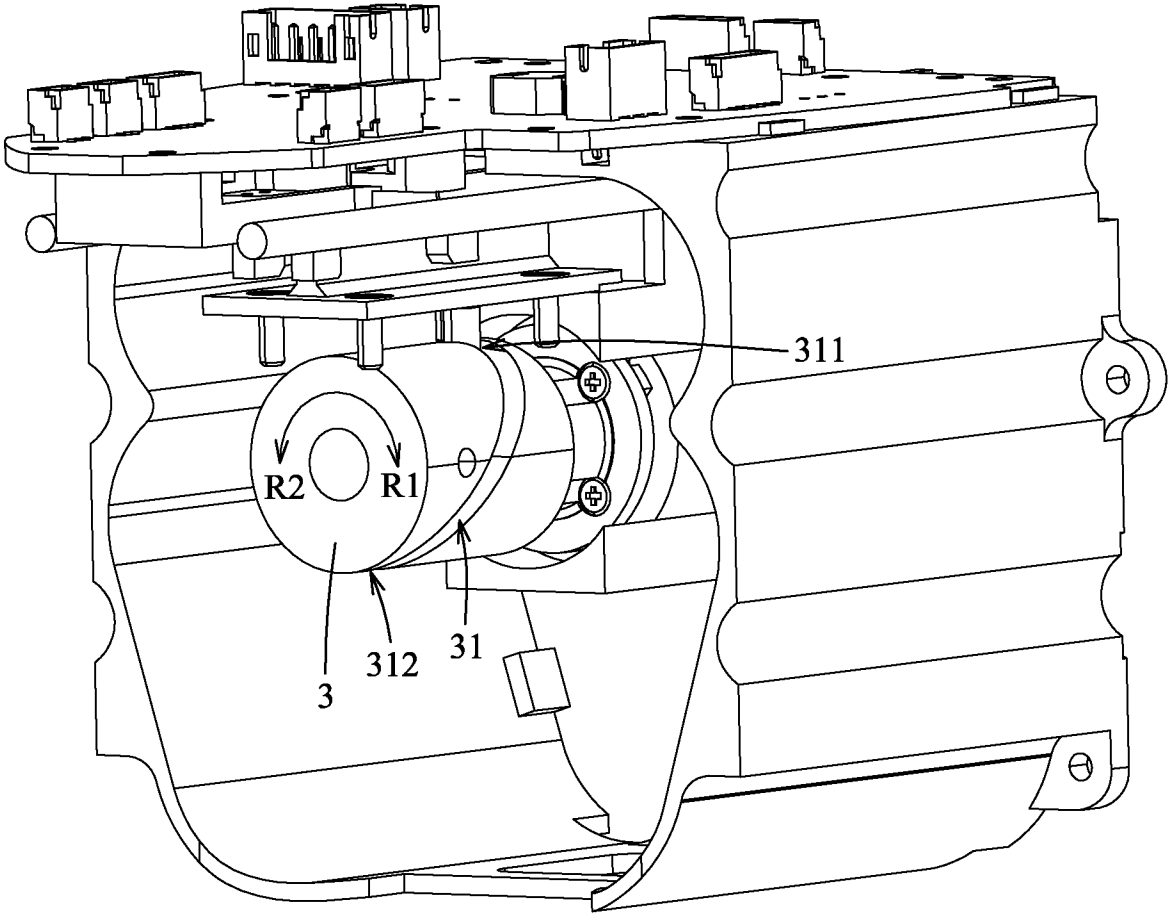
FIG. 10 is a perspective view similar to FIG. 3, but illustrating a modification of the embodiment.
Figure 11:
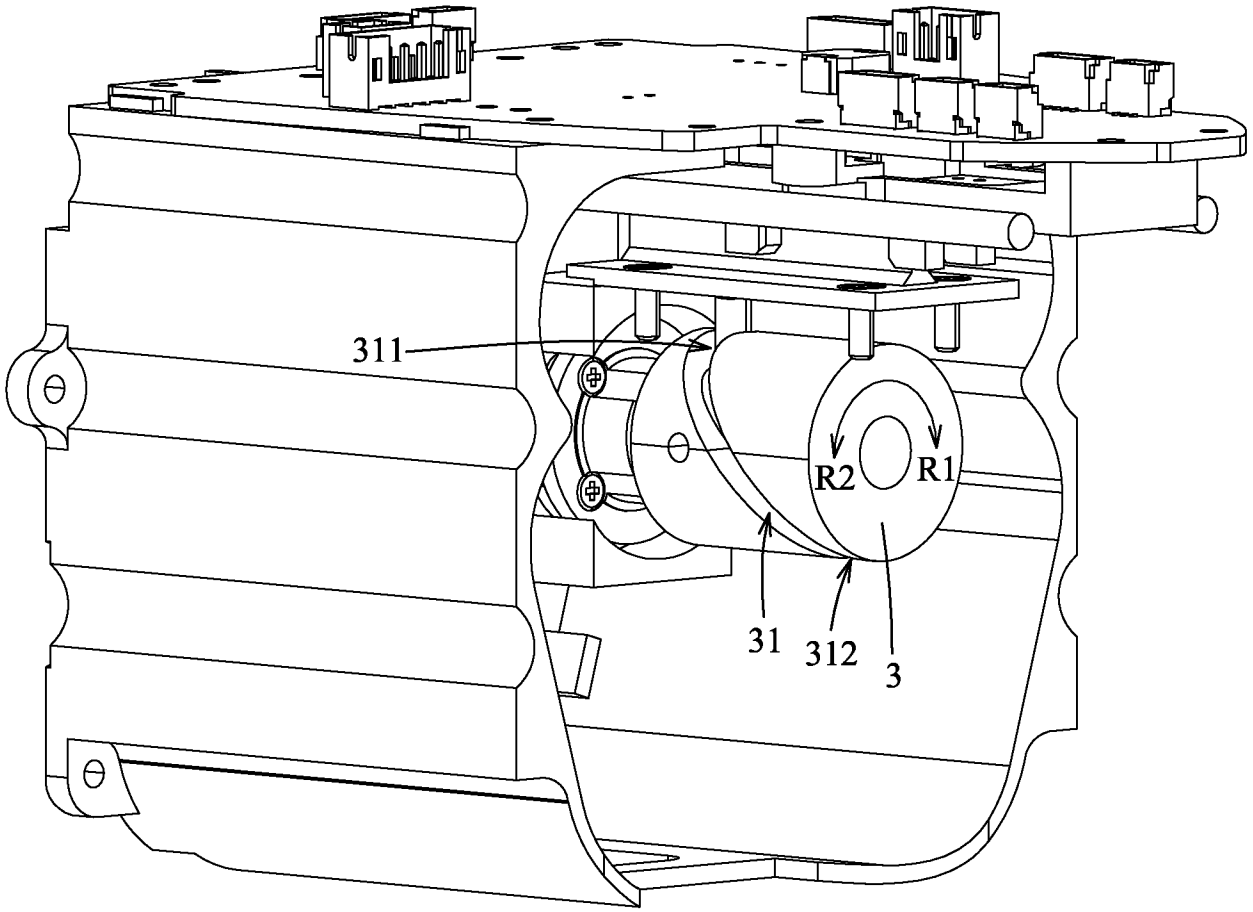
FIG. 11 is a perspective view of the modification in FIG. 10 from another view of angle different from FIG. 10.

Referring to FIGS. 10 and 11, a modification of the embodiment of the present disclosure is shown. In this modification, the cam groove 31 is annular, surrounds the driving shaft 24, and forms a closed loop. Specifically, the first positioning portion 311 and the second positioning portion 312 are disposed respectively at opposite sides of the axis of the driving shaft 24. As such, when the cam 3 is rotated for a half turn in the clockwise direction (R1), the engaging member 422 moves from the first positioning portion 311 to the second positioning portion 312 along a segment of the cam groove 31. Subsequently, when the cam 3 continues to rotate for another half turn in the clockwise direction (R1), the engaging member 422 moves from the second positioning portion 312 to the first positioning portion 311 along another segment of the cam groove 31. In this way, the motor 22 is able to move the weight unit 4 back and forth by driving the driving shaft 24 and the cam 3 to rotate in a single direction, i.e., the clockwise direction (R1). It should be noted that, the motor 22 may drive the driving shaft 24 and the cam 3 to rotate in the counterclockwise direction (R2) to allow the weight unit 4 to move along the axis of the driving shaft 24.

In summary, by virtue of the base seat 21 of the driving module 2 that carries the majority of weight of the weight unit 4, the driving shaft 24 of the driving module 2 carries less weight of the weight unit 4 so the possibility of the driving shaft 24 being worn out during rotation thereof may be greatly reduced, thereby improving durability of the driving shaft 24. Moreover, the configuration of the engaging member 422 that engages the cam groove 31 in a loose fitting manner decreases friction and energy loss between the engaging member 422 and the cam groove 31, so durability of the embodiment may also be increased. In addition, such configuration may also reduce assembling difficulty of the engaging member 422 and the cam groove 31 to thereby reduce manufacturing cost. Finally, by utilizing the power source assembly 41 as a weight of the biomimetic aquatic device for changing the center of gravity of the biomimetic aquatic device, no additional weight is required to be disposed in the housing 1 so the number of components in the housing 1 is fewer than that of a conventional biomimetic aquatic device as described in the background section of the disclosure, so an overall volume of the biomimetic aquatic device of the present disclosure may be reduced to achieve the effect of miniaturization.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A biomimetic aquatic device comprising:

a housing that has a receiving space therein;

a driving module that is disposed in said receiving space, and that includes a driving shaft rotatable about its own axis that extends in a front-rear direction;

a cam that is mounted co-rotatably to said driving shaft, and that has a cam groove formed in an outer surface of said cam and having at least a portion that extends spirally about the axis of said driving shaft; and a weight unit that is mounted to said driving module that is movable along the axis of said driving shaft relative to said driving module, and that includes an engaging member engaging and movable along said cam groove;

wherein, when said driving shaft and said cam are rotated, said weight unit moves relative to said driving module along the axis of said driving shaft via engagement between said engaging member and said cam groove, thereby changing a center of gravity of said biomimetic aquatic device.

2. The biomimetic aquatic device as claimed in claim 1, wherein said cam groove has a first positioning portion disposed at a rear portion of said cam, and a second positioning portion disposed at a front portion of said cam, said first positioning portion and said second positioning portion being at a same side of the axis of said driving shaft.

3. The biomimetic aquatic device as claimed in claim 2, wherein said cam groove extends spirally about the axis of said driving shaft.

4. The biomimetic aquatic device as claimed in claim 1, wherein said cam groove has a first positioning portion disposed at a rear portion of said cam, and a second positioning portion disposed at a front portion of said cam, said first positioning portion and said second positioning portion being disposed respectively at opposite sides of the axis of said driving shaft.

5. The biomimetic aquatic device as claimed in claim 4, wherein said cam groove is annular and surrounds said driving shaft.

6. The biomimetic aquatic device as claimed in claim 1, wherein said weight unit includes:

a power source assembly electrically connected to said driving module; and a driven element mounted fixedly to said power source assembly and including said engaging member.

7. The biomimetic aquatic device as claimed in claim 6, wherein:

said driving module further includes a base seat having an accommodating space retaining said driving shaft and said cam therein; and said power source assembly extends into said accommodating space, is movable along the axis of said driving shaft, and surrounds said cam.

8. The biomimetic aquatic device as claimed in claim 6, wherein:

said driving module further includes a base seat; and said biomimetic aquatic device further comprises a control module including a circuit board that is mounted outwardly of said base seat and that is configured to control rotation of said driving shaft, and two sensors that are electrically connected to said circuit board, that are spaced apart from each other in the front-rear direction, and that detect position of said driven element, such that said circuit board controls rotation of said driving shaft after receiving signals generated by said sensors.

* * * * *